United States Patent [19]

Miyazaki et al.

[11] Patent Number: 5,022,789

[45] Date of Patent: Jun. 11, 1991

[54] METHOD AND MACHINE FOR CONSTRUCTING SHAFTS

[75] Inventors: Akira Miyazaki; Yuichi Kikuchi; Yoshiyuki Ohara; Tomosburo Fujinaga; Takashi Kawata; Fumitoshi Mizutani, all of Tokyo; Tsugio Hida, Omuta; Shiroyasu Shimazaki, Tokyo, all of Japan

[73] Assignee: Shimizu Construction Co., Ltd., Tokyo, Japan

[21] Appl. No.: 273,368

[22] Filed: Nov. 17, 1988

[30] Foreign Application Priority Data

Nov. 18, 1987 [JP] Japan ..... 62-290967
Nov. 18, 1987 [JP] Japan ..... 62-290968
Nov. 18, 1987 [JP] Japan ..... 62-290970

[51] Int. Cl.[5] ..... E21D 1/06

[52] U.S. Cl. ..... 405/133; 405/146; 37/64; 299/56; 299/58

[58] Field of Search ..... 405/133, 146, 141, 138, 405/150; 37/64, 65; 299/56, 58, 62

[56] References Cited

U.S. PATENT DOCUMENTS

| | | | |
|---|---|---|---|
| 1,580,001 | 4/1926 | Bicknell | 299/62 |
| 3,310,124 | 3/1967 | Farmer | 175/7 |
| 3,334,945 | 8/1967 | Bartlett | 299/56 |
| 4,040,666 | 8/1977 | Uchida et al. | 405/141 X |
| 4,165,129 | 8/1979 | Sugimoto et al. | 299/56 X |
| 4,365,427 | 12/1982 | Chapman | 37/67 X |
| 5,397,970 | 10/1981 | Hodges | 37/65 X |

FOREIGN PATENT DOCUMENTS

| | | | |
|---|---|---|---|
| 2942635 | 4/1981 | Fed. Rep. of Germany . | |
| 3609111 | 10/1987 | Fed. Rep. of Germany . | |
| 2374504 | 7/1978 | France . | |
| 8408382 | 12/1985 | France . | |
| 130021 | 11/1959 | U.S.S.R. | 405/133 |
| 810978 | 3/1981 | U.S.S.R. | 405/133 |

OTHER PUBLICATIONS

Glückauf, "Herstellen von Schachten mit gestangelosen Schacht-bohrmaschinen", 1985, pp. 839-852.

Glückauf, *Mogliche Weiterentwicklungen des Vollschacht-bohrens, 1985, pp. 1444-1450.*

*Primary Examiner*—Dennis L. Taylor
*Assistant Examiner*—A. Olsen
*Attorney, Agent, or Firm*—Scully, Scott, Murphy & Presser

[57] ABSTRACT

There are disclosed a method and a machine for constructing a shaft having a substantially circular cross-section. According to the present invention, the shaft having a shotcrete formed on a peripheral wall thereof can be easily constructed. The shotcrete can be promptly formed on the peripheral wall by spraying concrete on the wall above the water level of the water in the shaft before the wall is damaged. Also, muck excavated from a working face of the shaft can be efficiently conveyed therefrom to outside of the shaft even if the shaft has a depth of more than hundreds of meters.

11 Claims, 8 Drawing Sheets

METHOD AND MACHINE FOR CONSTRUCTING SHAFTS

BACKGROUND OF THE INVENTION

1. Field of the Invention

The present invention relates to a method for constructing a very deep shaft having a depth of more than hundreds of meters. Further, the present invention is concerned with a machine suitable to perform the method above.

2. Prior Art

In order to construct such a deep shaft, work must be performed in steps: a step of approximately vertically excavating a soft rock to form a shaft and then a step of excavating muck generated by excavation of the shaft. With such a method, it is critical how to convey efficiently the muck out of the shaft because the efficient conveyance of the muck serves to reduce the term and cost of the construction of the shaft.

Known processes for conveying the muck are as follows:

(1) introducing the muck into a kibble or a bucket at the bottom of the shaft and then lifting it upward to the inlet of the shaft.

(2) filling the shaft with water and then raising the muck and the water upwards by means of an air-lifting pump.

(3) filling the shaft with water and pumping up the water including the muck by a method, called the reverse circulation method, and then separating the muck from the water.

Such conventional processes however have drawbacks. With the process (1), the conveyance of the muck can be merely intermittently performed and it takes much time to raise and lower the kibble or the bucket Therefore, the process (1) cannot be used as a process for constructing efficiently a shaft of a great depth.

With the processes (2) and (3), the conveyance of the muck can be continuously performed because the muck can be lifted up to the inlet of the shaft by filling the shaft with water. However, a peripheral wall of the shaft cannot be subjected to a primary lining or shotcrete made of a concrete because the shaft is filled with water. Also, an expensive excavator having properties such as watertightness, waterproofness and the like must be used for construction of the shaft. Further, the excavator must be drawn up when maintenance is done on the excavator outside of the shaft, or the water filled in the shaft must be pumped out when the maintenance is done in the shaft.

With such conventional methods, the muck in the bottom of the shaft cannot be efficiently conveyed outside thereof.

SUMMARY OF THE INVENTION

Accordingly, an object of the present invention is to obviate defects of the conventional methods and to provide a method for constructing efficiently a shaft of a great depth, which can reduce the term and cost of the construction of the shaft.

Another object of the present invention is to provide a machine suitable to perform the method above, which can excavate effectively the muck generated when excavating a soft rock from a working face, to the upper inlet of the very deep shaft.

According to a first aspect of the present invention, there is provided a method for constructing a shaft formed by excavating soft rock substantially vertically by means of an excavator, comprising steps:

(a) pouring water into the shaft so that only the lower end of the excavator is kept in the water with a constant water level relative to the working face;

(b) spraying concrete on a peripheral wall exposed above the water level to form a shotcrete thereon;

(c) mixing the water and muck excavated from the working face to obtain a slurry; and (d) conveying the slurry to the outside of the shaft.

According to a second aspect of the present invention, there is provided a machine for constructing a shaft comprising a body of an excavator to be in a shaft being excavated; a water supplement means for pouring water into the shaft and controlling the amount of flowing water to keep a constant water level relative to the working face; a mucking apparatus for mixing the water and muck excavated from the working face to obtain a slurry, and for pumping up the slurry; a slurry-conveying apparatus for conveying the slurry to the outside of the shaft; and a spray apparatus for spraying concrete on a peripheral wall exposed above the water level of the shaft to form a shotcrete.

BRIEF DESCRIPTION OF THE DRAWINGS

The invention will now be described with reference to the accompanying drawings wherein:

FIG. 4(*b*) is a view similar to FIG. 4(*a*) but showing the slurry-conveying apparatus including the first and second tanks in an alternative state to that of FIG. 4(*a*);

FIG. 6(*b*) is a cross-sectional view of the valve in FIG. 6(*a*);

DETAILED DESCRIPTION OF THE INVENTION

Figure 1:
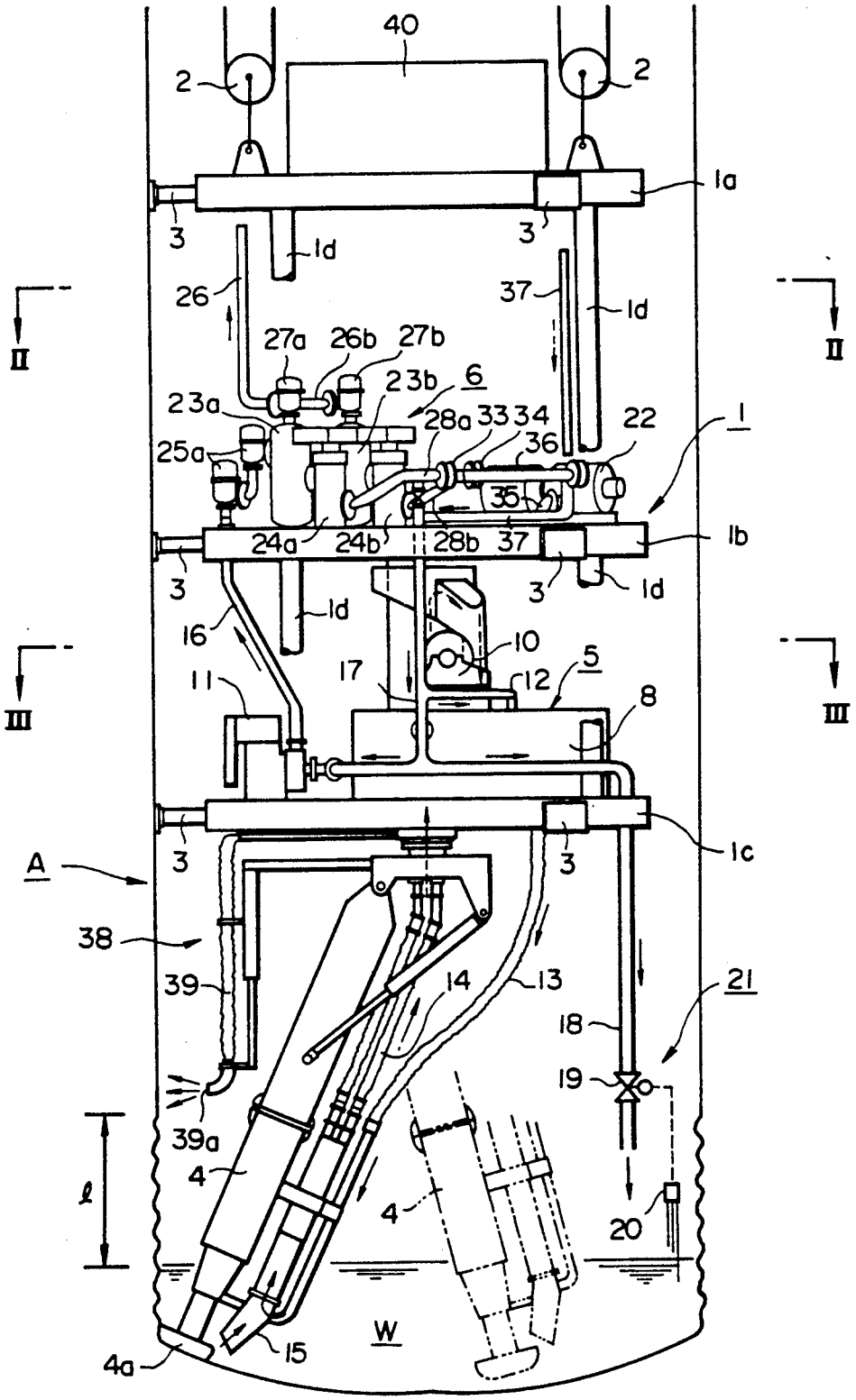
FIG. 1 is a side view showing a machine for constructing a shaft of the present invention.
Figure 2:
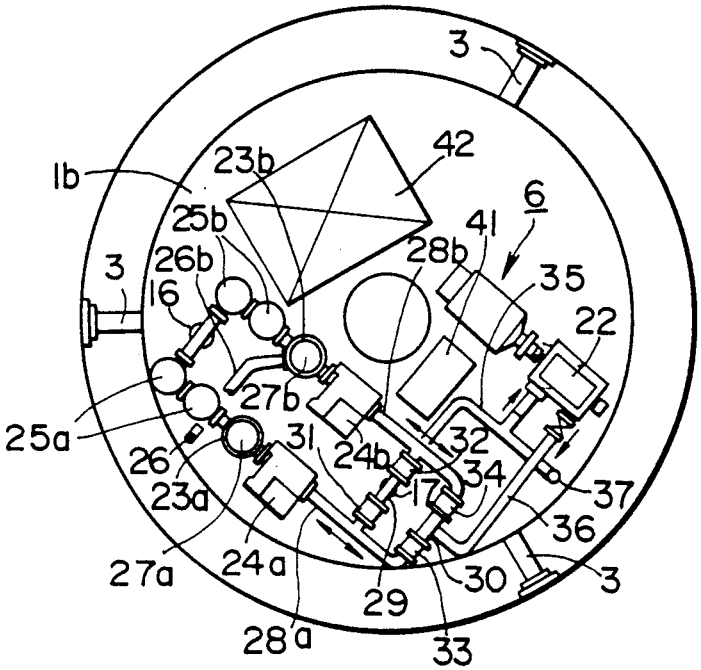
FIG. 2 is a sectional view taken along the plane II—II of FIG. 1.
Figure 3:
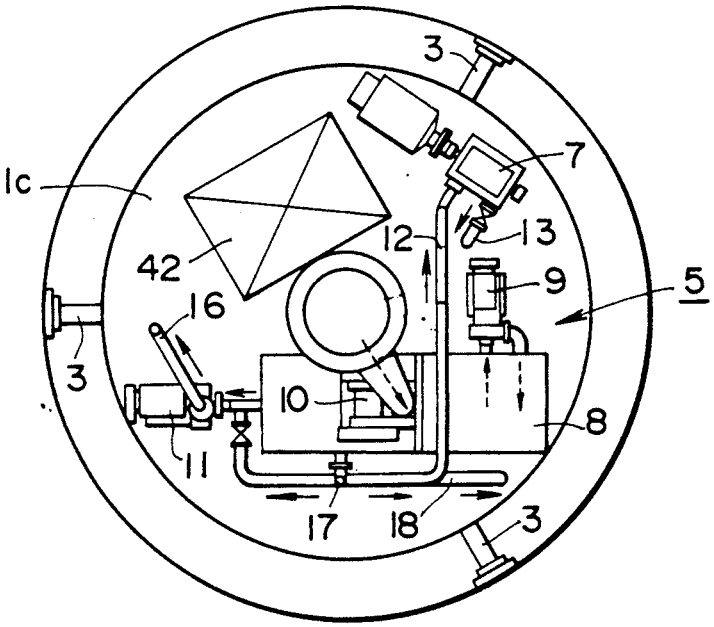
FIG. 3 is a sectional view taken along the plane III—III of FIG. 1.

FIGS. 1 to 3 show a machine by character A according to this invention, the machine A constructing a very deep shaft having a substantially circular cross-section. In these drawings, numeral 1 denotes a flying scaffold comprising an upper plate 1*a*, a middle plate 1*b*, a lower plate 1*c* and connecting members 1*d* for connecting between two of the plates 1*a* to 1*c*. Each of plates 1*a* to 1*c* having a circular cross-section includes a pair of circular faces having the same area as to each other and a peripheral face being formed along a peripheral portion of the circular faces. The outer diameter of each of the plates 1*a* to 1*c* is smaller than an inner diameter of a shaft to be drilled. A plurality of grippers 3 for maintaining the attitude of the scaffold 1 are disposed on each peripheral face of the plate at equal intervals. Namely, one end of each of the grippers 3 are fixedly connected to the peripheral face of the plate and each of the other ends are extended to a wall of the shaft to bring the other end into contact with the wall. The upper plate 1*a* and the middle plate 1*b* are connected with connecting members 1*d*, and the middle plate 1*b* and the lower plate 1*c* are connected with the same members 1*d*. For example, as for the upper and middle plates 1*a* and 1*b*, opposite ends of the connecting members 1*d* are fixedly connected to the peripheral portions of the circular faces thereof at equal intervals without rolling the scaffold 1 or twisting it. Three or more of the connecting members 1*d* are preferably used for connection between each two plates. Also plural sheaves 2 for suspending the scaffold 1 in the shaft are disposed on the upper plate 1*a*.

As shown in FIG. 1, the flying scaffold 1 is suspended between the upper inlet and the bottom of the shaft by the sheaves 2 and is maintained there by the grippers 3.

Numeral 4 denotes a red-shaped excavator comprising opposite ends. One end or the upper end of the excavator 4 is rotatably supported by the central portion of the lower plate 1*c*. The other end or the lower end is extended downward and has a bit 4*a* for excavating soft rock of the bottom of the shaft. A shaft having an optional cross-section can be formed by using the excavator 4 because the bit 4*a* disposed on the lower end of the excavator 4 can be rotated.

A first conveying apparatus 5 or mucking apparatus for conveying muck to be excavated to a following apparatus is disposed on the lower plate 1*c*, and a second conveying apparatus 6 or slurry-conveying apparatus for conveying slurry suspending the muck to the upper inlet of the shaft is disposed on an upper face of the middle plate 1*b*.

As shown in FIGS. 1 and 3, the first conveying apparatus 5 comprises a pump 7 for generating a jet water, a crusher 10 for crushing the muck drawn up from the bottom of the shaft by the jet water to a small size, a tank 8 for receiving a mixture including the crushed muck and the water, a pump 9 for agitating the mixture to obtain slurry and a slurry pump 11 for conveying the slurry to the second conveying apparatus 6.

The pump 7 supplied with water including no muck by a pipe 12 is connected to one end of a pipe 13 for ejecting the jet water generated by the pump 7. The other end of the pipe 13 passes through the lower plate 1*c* and extends downward to the lower end of a pipe 14 to excavate the muck. One end of the pipe 14 is rotatably supported by the central portion of the lower face of the lower plate 1*c*, and the other end or the lower end of the pipe 14 is extended downward and is connected with a portion of the bit 4*a* of the excavator 4 so that the pipe 14 accompanies the excavator 4. An inlet 15 for drawing up the muck and the water into the pipe 14 is disposed at the lowest end of the pipe 14. The muck and the water are drawn up by virtue of an upward flow generated by the jet water form the pump 7 to be introduced into pipe 14 and are supplied to the crusher 10. In the crusher 10, the muck is ground to a small grain. Such muck and water are introduced into the tank 8 and agitated by the pump 9 to obtain a slurry. The slurry is conveyed through a conveyance pipe 16 to the second conveying apparatus 6 by the slurry pump 11.

The pipe 12 linked with the pump 7 is connected with a supplement pipe 17. The supplement pipe 17 is connected through a suction pipe 35 of a main pump 22 as described below with a return flow pipe 37. The supplement pipe 17 is also connected with both the tank 8 and the slurry pump 11 in order to supply them with water. Further, the supplement pipe 17 is connected with a pipe 18 for supplying water to the working face of the shaft. The pipe 18 has a valve 19 for controlling the flow rate of water. Gate opening of the valve 19 is controlled on the basis of the water level at the working face measured by a water gauge 20 to adjust the amount of water supplied to the working face. The water level is determined by a water supplement means 21 for supplying water to the working face so as to keep a constant water level. The water supplement means 21 comprises the pipe 18, the valve 19 and the water gauge 20. In FIG. 1, plural arrows show the flow of water or slurry.

On the other hand, as shown in FIGS. 1 and 2, the second conveying apparatus 6 comprises the main pump 22, a pair of tanks 23*a* and 23*b*, and two filters 24*a* and 24*b* disposed in the tanks 23*a* and 23*b*, respectively, each filter filtrating slurry filled in the tank, the pump 22 draining water from the tanks.

The constitution and operation of the second conveying apparatus 6 will now be described below in greater detail.

Figure 4A:
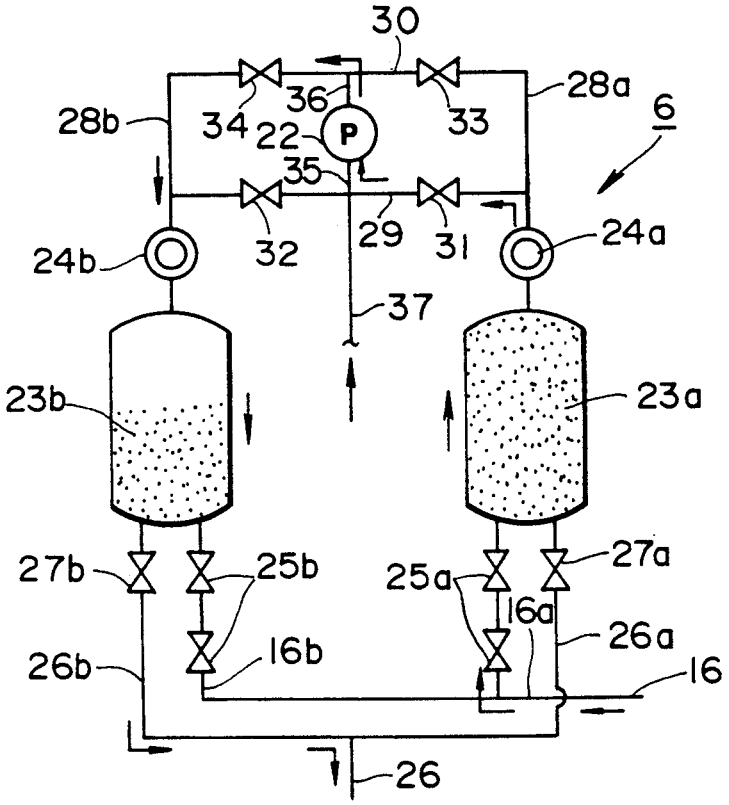
FIG. 4(*a*) is a schematic view showing a slurry-conveying apparatus including a first tank and a second tank, a slurry is introduced into the first tank and the muck of the slurry is stored therein, and the muck stored in the second tank being washed away therefrom by water supplied from the first tank thereto.
Figure 4B:
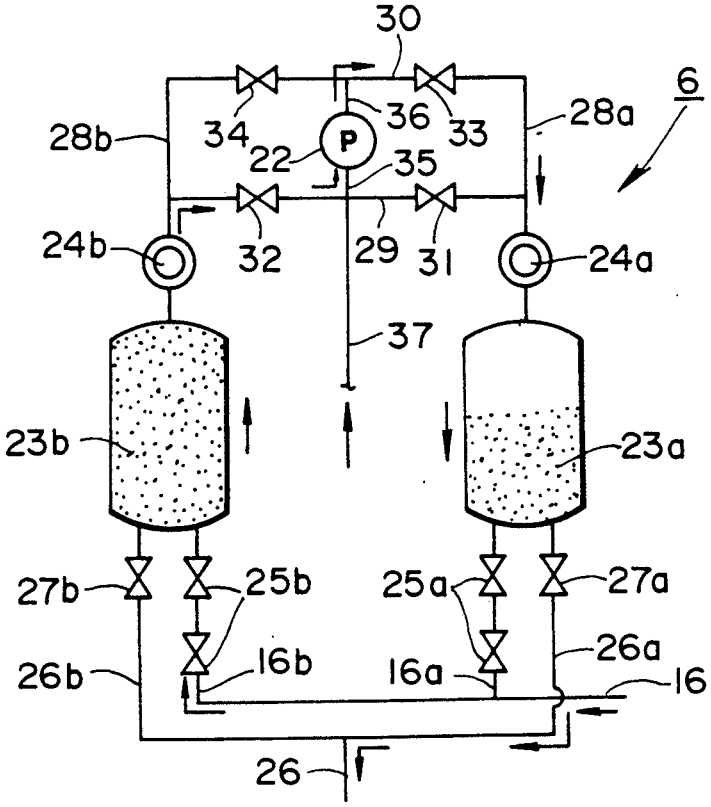

As shown in FIG. 4(*a*), the tanks 23*a* and 23*b* are connected through check valves 25*a* and 25*b* respectively with branch pipes 16*a* and 16*b* branching from the conveyance pipe 16. The check valves 25*a* and 25*b* serve to prevent slurry in the tanks 23*a* and 23*b* from flowing into the conveyance pipe 16. The tanks 23*a* and 23*b* are also connected through check valves 27*a* and 27*b* with branch pipes 26*a* and 26*b* branching from one end of a conveyance pipe 26. The other end of the conveyance pipe 26 is extended to the upper inlet of the shaft in order to convey muck of a slurry to outside of the shaft. The filters 24*a* and 24*b* are connected with header pipes 28*a* and 28*b*. These pipes 28*a* and 28*b* are connected to each other by pipes 29 and 30. The pipe 29 has valves 31 and 32, and the pipe 30 has valves 33 and 34. The suction pipe 35 of the main pump 22 is connected with the pipe 29 between the valves 31 and 32. A delivery pipe 36 of the main pump 22 is connected with the pipe 30 between the valves 33 and 34.

In the second conveying apparatus 6, the slurry is conveyed into the tanks 23*a* or 23*b* to be stored therein. At the same time, the muck of the slurry already held in the tanks 23*b* or 23*a* is conveyed to outside of the shaft. By the apparatus 6, the muck can be continuously excavated and conveyed to outside of the shaft.

As shown in FIG. 4(*a*), when the main pump 22 is actuated under the conditions that the valves 31 and 34 are opened, and that the valves 32 and 33 are closed, the slurry is introduced through the check valve 25*a* into the tank 23*a*. The slurry conveyed from the tank 23*a* is filtrated by the filter 24*a*, so that muck of the slurry is stored in the tank 23*a*. The water passed through the filter 24*a* is conveyed through the filter 24*b* to the tank 23*b* and conveyed together with the muck already reserved in the tank 23*b* through the check valve 27*b* to the conveyance pipe 26 and then to outside of the shaft.

After conveying the muck to outside, the valves 31 and 34 are closed, and the valves 32 and 33 are opened. As a result, the direction of the slurry flow is opposite to that of the previous flow. In this case, water of the slurry is gradually drained from the tank 23*b* and thus the muck is left. On the other hand, the muck already reserved in the tank 23*a* is conveyed with water to the conveyance pipe 26. The muck is then conveyed to outside of the shaft and then is separated from the water. The water separated from the muck is supplied through the return flow pipe 37 to the main pump 22. A part of the water is also supplied through supplement pipe 17 to the pump 7, the tank 8 and the slurry pump 11 of the first conveying apparatus 5, and is further supplied through the supplement pipe 18 to the working face of the shaft by virtue of the water supplement means 21.

Furthermore, the thus-described machine A has a spray apparatus 38 for spraying concrete on the peripheral wall of the shaft to form a shotcrete thereon. As shown in FIG. 1, the apparatus 38 comprises a spraying pipe 39 and a concrete supplement apparatus 40 for supplying concrete to the spraying pipe 39. Namely, one end of the spraying pipe 39 is rotatably supported by the lower plate 1*c* of the scaffold 1 so as to rotate along the peripheral wall about an axis of the lower plate 1*c* and the other end or a lower end of the pipe 39 is extended along the axis of the lower plate 1*c* to a position near the water surface. A spraying nozzle 39*a* is disposed at the lowest end of the pipe 39 and is aimed at the peripheral wall. The concrete supplement apparatus 40 is disposed on the upper plate 1*a*.

Numeral 41 in FIG. 2 denotes an oil pressure unit for actuating the plural pumps as described above. Also, numeral 42 in FIGS. 2 and 3 denotes a gate for enabling machines or goods such as tools and the like to be passed through. A dust collector (not shown) is disposed on the upper plate 1*a* of the scaffold 1.

A method for constructing a very deep shaft using the machine A as above-mentioned will now be described below.

The flying scaffold 1 is suspended in the shaft by virtue of the sheave 2 and then the attitude of the scaffold 1 is maintained by using the grippers 3. Water represented by character W is introduced into the bottom of the shaft by the water supplement means 21 so that the machine A is partially immersed in the water W, namely only the bit 4*a* of the excavator 4. Subsequently, the drilling is performed by the excavator 4 and then the first and second conveying apparatuses 5 and 6 are actuated. As described above, the muck drilled from the working face of the shaft are changed into a slurry to be removed to the outside of the shaft. In the excavation of the slurry, although the water W is reduced because the water W is sucked up together the muck, the water level of the water W is kept constant by virtue of the water supplement means 21.

At the same time, the peripheral wall exposed above the surface of the water W is subjected to spray of concrete to form a primary shotcrete thereon. In this case, distance from the water surface to the wall being applied with the primary shotcrete is preferably short. For example, the distance represented by character 1 is between about 1 meter and 3 meters.

According to the method as described above, the machine A including the excavator 4 and another apparatus assembled thereon is required of no properties such as watertightness, waterproofness and the like because the level of the water W is kept at a constant level so that the machine A is partially immersed in the water W. Also, since the water W is shallow, maintenance on the machine A such as exchange of bits and the like can be easily and promptly performed at the bottom of the shaft or a shaft to be constructed.

Further, the muck at the working face can be continuously and efficiently excavated by means of the first and second conveying apparatuses 5 and 6 in comparison with conventional method using kibbles or buckets to excavate the muck. Especially, the second conveying apparatus 6 can have an output power sufficient for lifting up a large amount of the muck from the bottom of the shaft to the upper inlet thereof, and therefore the term and cost of the construction of the shaft can be reduced.

The inlet of the main pump 22 for conveying slurry upward is subjected to water pressure corresponding to the distance between the pump 22 and the upper inlet of the shaft or depth of the pump 22. Therefore, the output pressure of the pump 21 can be reduced by the inlet water pressure resulting in saving energy.

According to the method, shotcrete can be promptly formed on the peripheral wall of the shaft by spraying concrete on the peripheral wall above the water level of the water W before the peripheral wall is broken. Therefore, the excavation according to the method can be performed in safety even if water suddenly springs up from the working face.

As for the constitution of the scaffold 1, the excavator 4, the first and second conveying apparatuses 5 and 6, the water supplement means 21 and the spray apparatus 38 as described above, this should in no way be construed as limiting the present invention.

A plurality of the second conveying apparatuses 6 may be used as relaying apparatuses to the upper inlet of the shaft on the occasion that a shaft to be drilled has a great depth, and that the slurry cannot be conveyed by using one apparatus 6 having power insufficient for conveying it from a bottom of the shaft to an upper inlet thereof.

FIGS. 5 to 8 show another variation of the second conveying apparatus 6 as described above. Numeral 100 denotes a primary conveying apparatus.

The primary conveying apparatus 100 comprises a first jet pump 120, an actuation pump 121, a water supplement pipe 122, a conveyance pipe 123 and an agitation tank 124. The jet pump 120 is a pump for pumping up muck together with the water W by a suction generated because of a jet water supplied through the water supplement pipe 122 from the actuation pump 121 and then conveying the muck through the conveyance pipe 123 to the agitation tank 124. By virtue of the agitation tank 124, the muck is mixed with water to produce a slurry. The slurry is introduced through a slurry supplement pipe 125 into three kinds of tanks Ta, Tb and Tc, and the surface water of the slurry in the tank 124 is repeatedly returned through a return flow pipe 126 to the working face.

Each of the pressure tanks Ta, Tb and Tc has a capacity sufficient for receiving a predetermined amount of the slurry. Although each tank is shown lying horizontally in FIG. 5, it is arranged vertically in actual practice. Bottoms of the pressure tanks Ta, Tb and Tc are connected through check valves 127*a*, 127*b* and 127*c* with the slurry supplement pipe 125, respectively. The tops of the pressure tanks Ta, Tb and Tc are connected with the bottom ends of header pipes 130*a*, 130*b* and 130*c*, respectively. The other ends of the header pipes 130*a*, 130*b* and 130*c* are connected with main ports $P_1$ of three-port-connection-valves Va, Vb and Vc. Further, filters Fa, Fb and Fc for filtering muck from the slurry are disposed between the pressure tanks and the three-port-connection-valves, respectively.

Figure 6A:
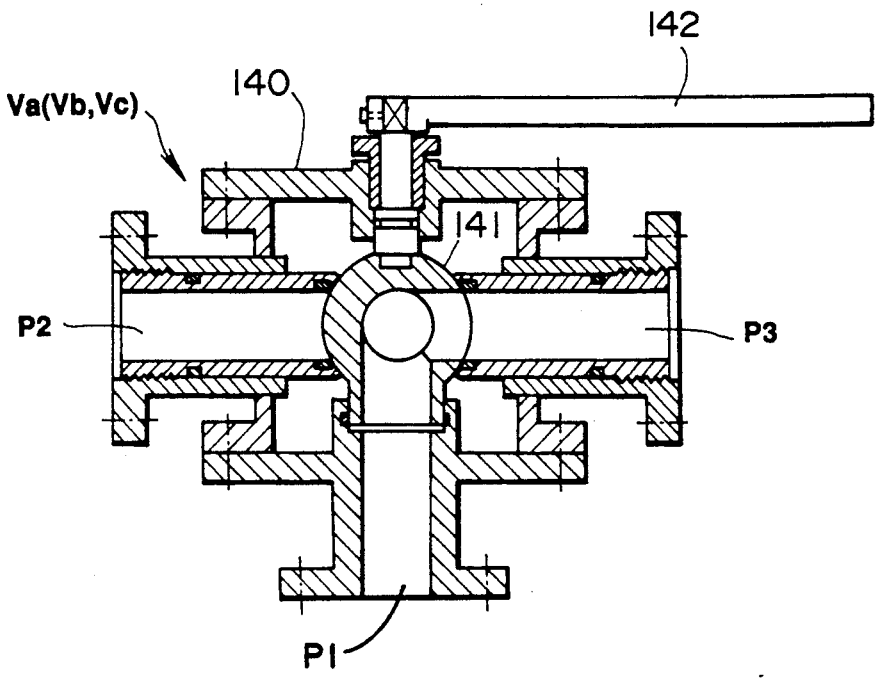
FIG. 6(*a*) is an axial-sectional view of a three-port-connection-valve for selecting two ways: one way for supplying water to the tank and the other way for drawing the water from the tank.
Figure 6B:
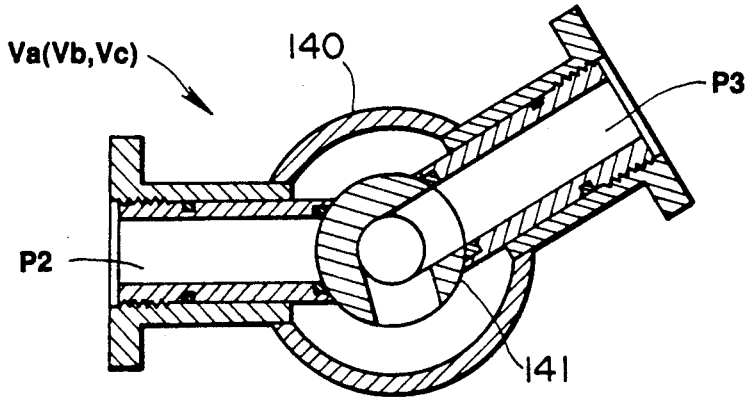

As shown in FIG. 6, each of the three-port-connection-valves Va, Vb and Vc comprises a substantially cylindrical valve cage 140 and a substantially spherical valve element 141 rotatably disposed therein. The valve cage 140 includes the main port $P_1$ being disposed vertically at the bottom thereof, an inlet port $P_2$ and an outlet port $P_3$ each being disposed horizontally at the side portions. A lever 142 for rotating the valve element 141 is connected with a top portion of the valve element 141. By operating the lever 142, the inlet port $P_2$ or the outlet port $P_3$ and the main port $P_1$ can be selectively connected to each other. FIG. 6 shows a three-port-connection-valve connecting the main port $P_1$ with the outlet port $P_3$.

Figure 5:
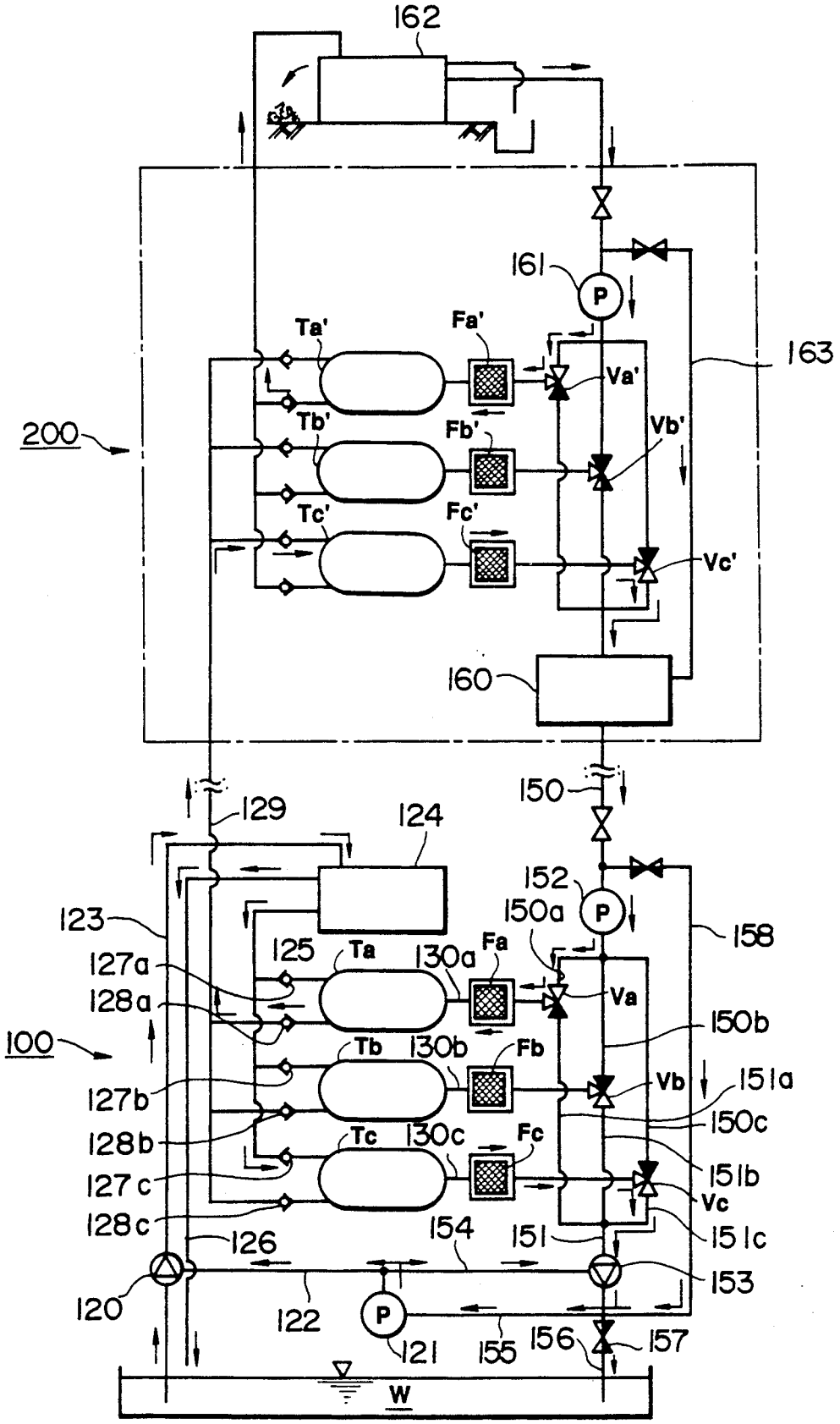
FIG. 5 is a schematic view showing another embodiment of a slurry-conveying apparatus having three tanks, the slurry being introduced into a first tank, muck of the slurry being stored in a second tank, a third tank being in conversion from the introduction of the slurry to the storage of the muck or the reverse order.

As shown in FIG. 5, the inlet ports $P_2$ of the three-port-connection-valves Va, Vb and Vc are connected with branch pipes 150*a*, 150*b* and 150*c* branching from a water supplement pipe 150, respectively. The outlet ports $P_3$ are connected with branch pipes 151*a*, 151*b* and 151*c* branching from a drain pipe 151, respectively. A second actuation pump 152 is disposed in the water supplement pipe 150, and a second jet pump 153 having property and power the same as the first jet pump 120 as described above is disposed in the drain pipe 151. The actuation pump 152 is a pump for supplying water through the three port connection valves and the filters to the pressure tanks as shown in FIG. 5, to thereby wash away the muck stored in the tanks. The second jet pump 153 is a pump for pumping water out through the filters and the three-port-connection-valves from the tanks as shown in FIG. 5, by using suction generated by a jet water supplied through a jet water supplement pipe 154 from the first actuation pump 121, to thereby store muck of the slurry in the tanks. The jet pump 153 is a pump for returning the water pumped through a return flow pipe 155 to the first actuation pump 121, and further for supplying a part of the water pumped, through a water supplement pipe 156 to the working face. The amount of the water supplied from the jet pump 153 to the working face is controlled on the basis of the gate opening of a valve 157 disposed in the water supplement pipe 156 so that the water level relative to the working face is kept constant. An inlet of the main pump 152 and an outlet of the jet pump 153 are connected by a pipe 158 for supplying water of the water supplement pipe 150 directly to the working face.

Each of the three-port-connection-valves Va, Vb and Vc is set up to synchronize with another.

The synchronization of the valves Va, Vb and Vc will now be described below with references to FIGS. 7 and 8. The gate openings of the valves Va, Vb and Vc, which correspond to the working time, are shown in order from the upper to the lower portion of FIG. 7.

Opening and closing of the valves are repeatedly performed at a cycle time or period represented by character T. The valves are actuated to have a time lag represented by character $t_1$ to each other. For example, the valve Va is actuated as follows.

The inlet port $P_2$ is fully opened as shown in FIG. 8(*a*) during the time $t_1$. Subsequently, the inlet port $P_2$ is gradually closed and then the outlet port $P_3$ is gradually opened during a time $t_2$. As a result, the outlet port $P_3$ is fully opened as shown in FIG. 8(*b*) and then this state is kept during a time $t_3$. Subsequently, the outlet port $P_3$ is gradually closed as shown in FIG. 8(*c*) and the outlet and inlet ports $P_3$ and $P_2$ are fully closed together as shown in FIG. 8(*d*) and the inlet port $P_2$ is gradually opened as shown in FIG. 8(*e*) and then the inlet port $P_2$ is fully opened again as shown in FIG. 8(*a*).

The same procedures as the valve Va are repeated for the valve Vb with a delayed time $t_1$ and the same procedures as for the valve Vb are repeated for the valve Vc with the delayed time $t_1$. Namely, the inlet port $P_2$ of the valve Vb is fully opened as the state of full opening of the valve Va is finished. The inlet port $P_2$ of the valve Vc is fully opened as the state of full opening of the valve Vb is finished. Further, the inlet port $P_2$ of the valve Va is fully opened again as the state of full opening of the valve Vc is finished. Also, the same procedures as for the inlet ports $P_2$ are repeated for the outlet ports $P_3$. When only one of the inlet ports $P_2$ of the three valves is fully opened, one of the outlet ports $P_3$ of the other two valves is fully opened, and the remainder is in gradual conversion to full-opening from the outlet port $P_3$ to the inlet port $P_2$.

As for the primary conveying apparatus 100 provided with the valves Va, Vb and Vc as described above, the flow of water conveyed by the main pump 152 and those of water pumped up into the slurry are changed in sequence. Therefore, the slurry obtained in the agitation tank 124 is pumped up into one of the pressure tanks Ta, Tb and Tc to be filled thereinto. At the same time, the muck filled into one of the other two tanks is washed away. At the same time, the slurry introduced into the remainder is in gradual conversion from being pumped up to being washed away.

Figure 7:
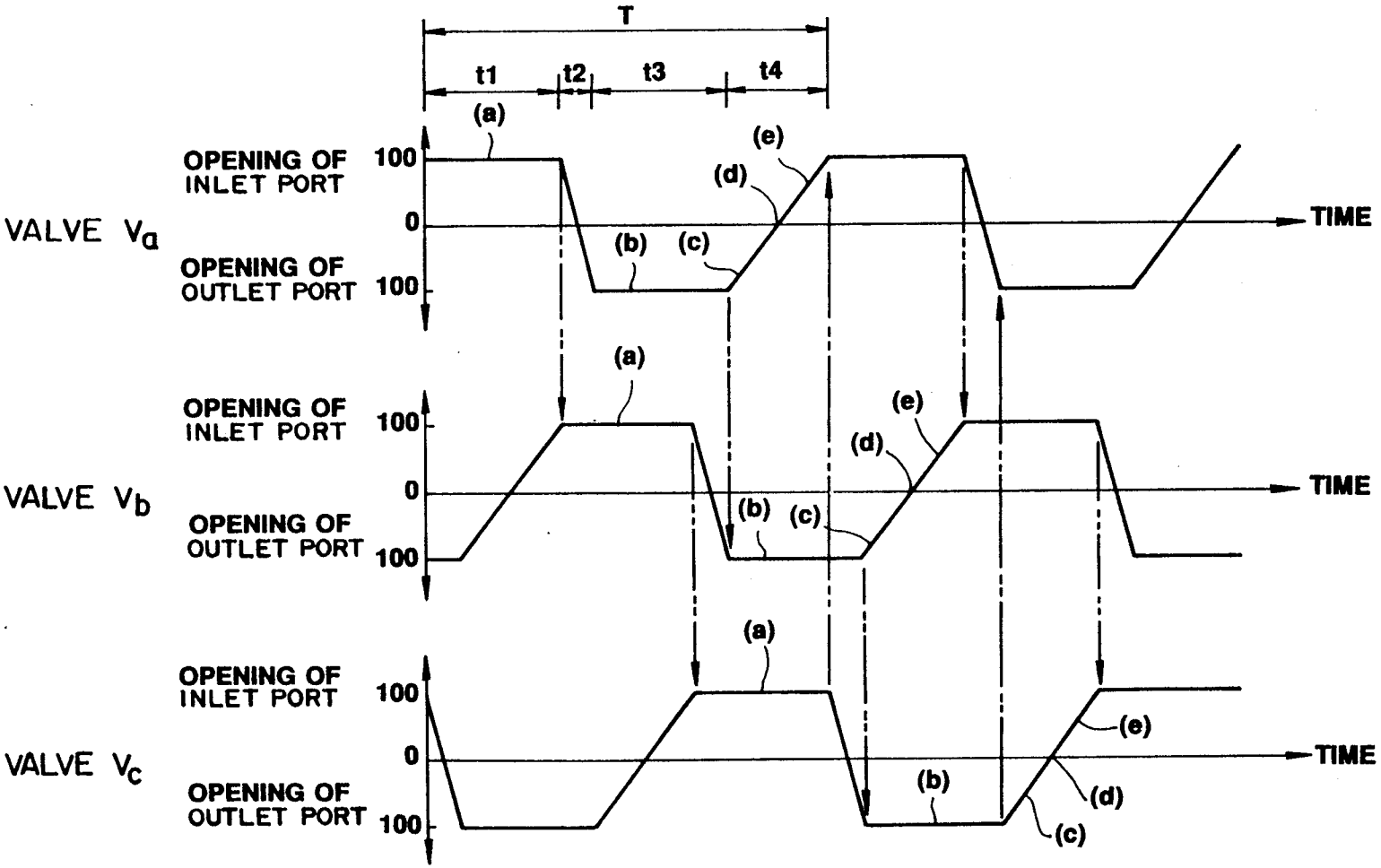
FIG. 7 is a graph showing an open and closed condition of the valves corresponding to working time.
Figure 8A:
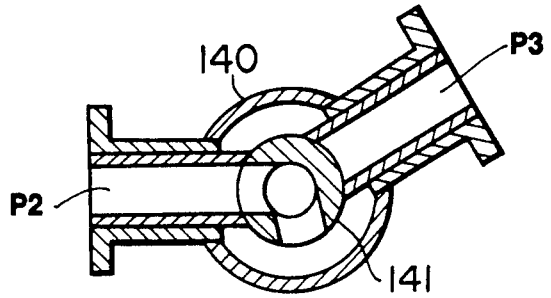
FIGS. 8(*a*) to 8(*e*) are fragmentary cross-sectional views of the valves in various stages of opening.
Figure 8B:
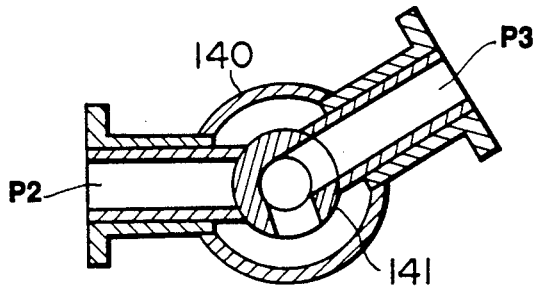
Figure 8C:
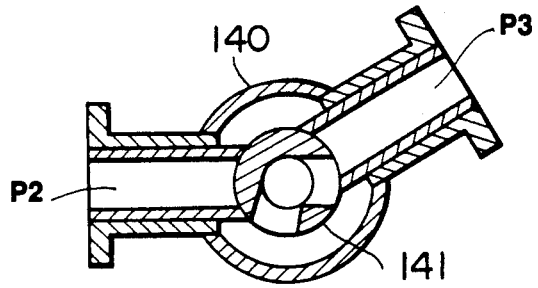
Figure 8D:
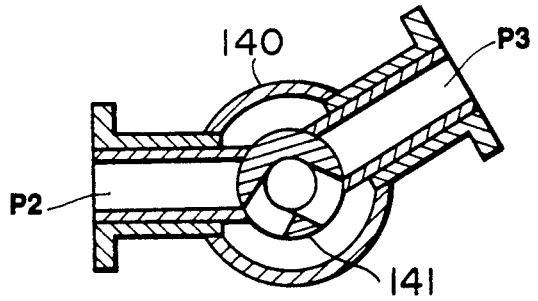
Figure 8E:
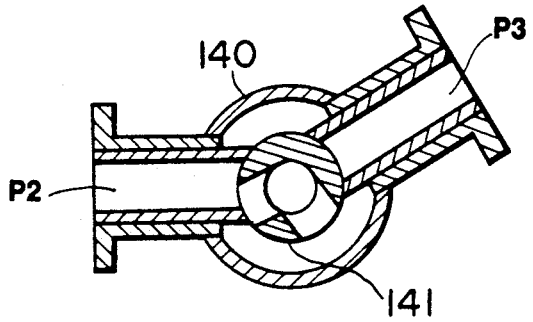

As shown in FIG. 7, when the inlet port $P_2$ of the valve Va is fully opened, the outlet port $P_3$ of the valve Vc is fully opened. At this time, the water conveyed from the main pump 152 is introduced through the filter Fa into the tank Ta. Also, the muck reserved in the tank Ta is washed away through a pipe 129 toward the secondary conveying apparatus 200. At the same time, the water of the slurry reserved in the tank Tc is pumped up through the filter Fc by the jet pump 153, and the slurry of the agitation tank 124 is sucked up into the tank Tc to increase gradually the content of the muck in the tank Tc. At this time, the valve Vb is in gradual conversion from the pumping-up to the washing-away state. Therefore, as the muck is finished being washed away from the tank Ta by closing the inlet port $P_2$ of the valve Va, the muck begins to be washed away from the tank Tb. At the same time, the tank Ta begins to be pumped up with the muck thereinto and the tank Tc begins to be in gradual conversion from the pumping-up to the washing-away state.

According to the primary conveying apparatus 100, the three tanks, Ta, Tb and Tc can perform the following works at the same time, respectively. Namely, one of the tanks Ta, Tb and Tc has the muck washed away, one of the other two tanks is pumped up with the slurry, and the remainder is in gradual conversion from the pumping-up to the washing away state. By virtue of this work of the tanks Ta, Tb and Tc, the muck can be continuously washed away from one of the tanks. Therefore, the primary conveying apparatus 100 can efficiently convey the muck of the working face to a secondary conveying apparatus 200.

The secondary conveying apparatus 200 is an apparatus for further conveying the slurry obtained by the primary conveying apparatus 100 to the upper inlet of the shaft, comprising essentially the same elements as the primary conveying apparatus 100 except that the actuation pump 121 and the agitation tank 124 are omitted from the apparatus 200 and that a storage tank 160 is added thereinto. Namely, the apparatus 200 comprises three pressure tanks Ta', Tb' and Tc' and a main pump 161. The tanks Ta', Tb' an Tc' have filters Fa', Fb' and Fc', and three-port-connection-valves Va', Vb' and Vc', respectively. According to the apparatus 200, the slurry conveyed from the apparatus 100 is introduced through the pipe 129 into one of the tanks Ta', Tb' and Tc' to be reserved therein and the slurry reserved in one of the other two tanks is washed away by the water supplied from the main pump 161, to be conveyed to the upper inlet of the shaft. At the same time, the remainder of the tanks begin to be in gradual conversion from the introduction of the slurry to the washing-away state.

The slurry conveyed to the upper inlet of the shaft by the secondary conveying apparatus 200 is introduced into a disposal tank 162 and then subjected to separation and the resulting solid or much is suitably disposed. The water separated from the slurry comes back again to the main pump 161 and a part of the water is directly supplied through a water supplement pipe 163 to the storage tank 160. Also, the water of the slurry filtrated by the filters Fa', Fb' and Fc' is stored in the storage tank 160 and them comes back through the water supplement pipe 150 to the main pump 152 of the primary conveying apparatus 100.

According to the method of the present invention using the primary conveying apparatus 100, the slurry drilled from the working face can be continuously excavated to outside of the shaft. Also, a great deep shaft having a depth of, e.g., more than hundreds of meters can be efficiently constructed by disposing relay apparatuses such as the secondary conveying apparatus 200 and the like on the way of the shaft on the basis of the depth of the shaft.

As for the main pumps 152 and 161, the main pump 152 is subjected to hydrostatic pressure corresponding to height therefrom to the storage tank 160, and the main pump 161 is subjected to hydrostatic pressure corresponding to height therefrom to the disposal tank 162. Therefore, they can sufficiently work if they have power for overcoming friction caused between the slurry and an inner wall of the pipes, and corresponding difference of density between the water and the slurry. They need no power for conveying muck from a bottom of the shaft to the inlet. Also, they have no risk of breaking down because only water filtrated by the filters passes therethrough.

Figure 9:
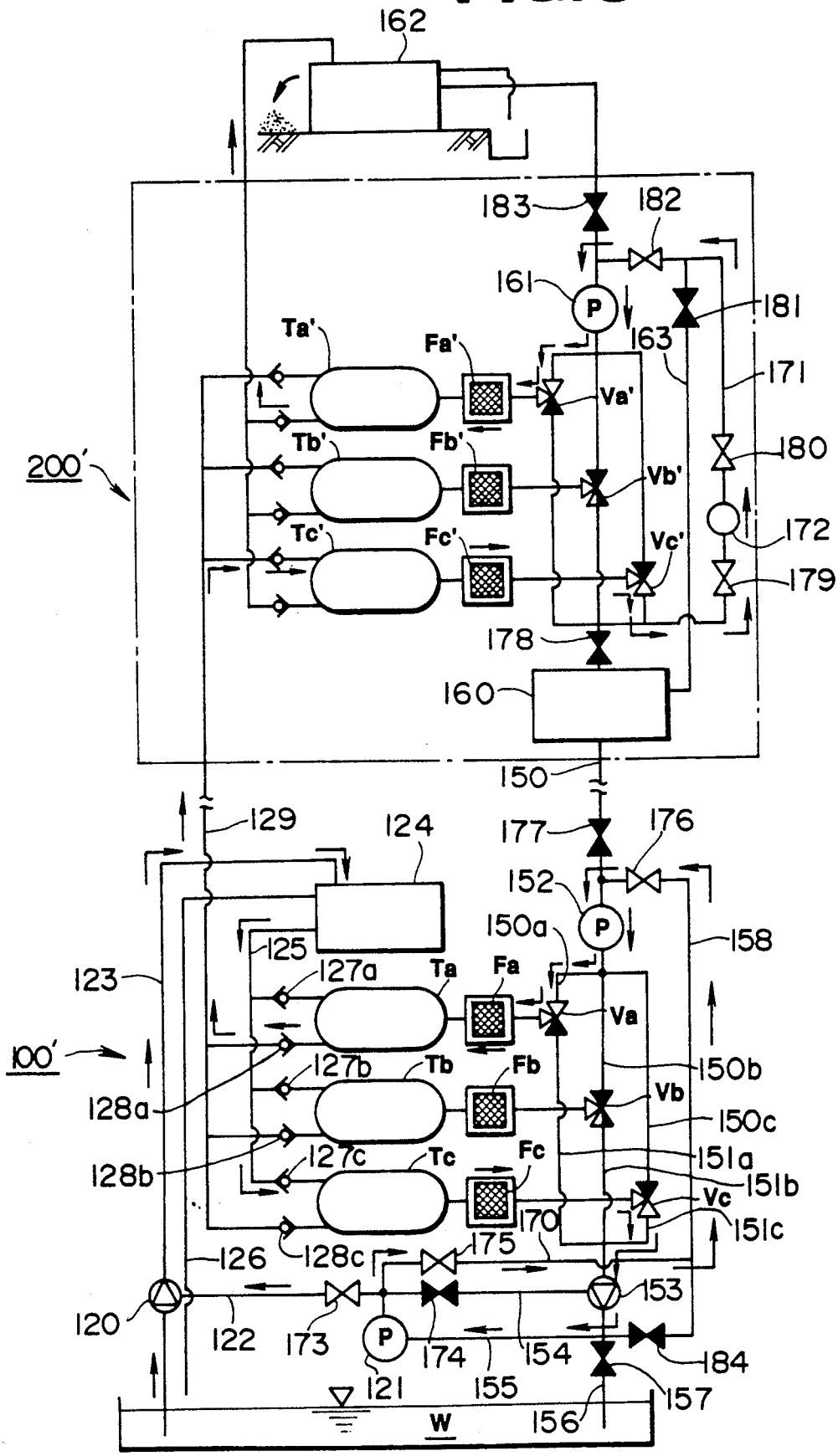
FIG. 9 is a schematic view showing another apparatus having three tanks for conveying slurry to outside of the shaft.

FIG. 9 shows another variation of the primary and secondary conveying apparatuses as described above. A system comprising primary and secondary conveying apparatuses 100' and 200' serves to drain a large amount of flood water, in addition to conveying muck to outside of the shaft.

The primary conveying apparatus 100' has a drain pipe 170 for connecting the actuation pump 121 with the water supplement pipe 158, and the secondary conveying apparatus 200' has a bypass pipe 171 for connecting an inlet of the storage tank 160 with the water supplement pipe 163. A drain pump 172 is disposed on the way of the bypass pipe 171. Numerals 173 to 184 denote valves disposed on the way of the pipes, respectively.

The ordinary workings of the system as shown in FIG. 9 are substantially identical to those of the system as shown in FIG. 5. However, when the flood water is suddenly generated, the following works are performed. Namely, the valves 173, 175, 176, 179, 180 and 182 are opened, and the valves 157, 174, 177, 178, 181, 183 and 184 are closed, respectively. At the same time, the three-port-connection-valves Va, Vb, Vc, Va', Vb' and Vc' are worked in ordinary ways and the jet pumps 120 and 153, the actuation pump 121, the main pumps 152 and 161 and the drain pump 172 are worked, respectively. As a result, the water W can be pumped up from the working face by the jet pump 120 and further pumped up through one tank, e.g., the tank Tc as shown in FIG. 9, the jet pump 153, the actuation pump 121, the main pump 152, another tank, e.g., the tank Ta as shown in FIG. 9 to the secondary conveying apparatus 200'. In the apparatus 200', the pumped-up water W is pumped up through one tank, e.g., the tank Tc' as shown in FIG. 9, the drain pump 172, the main pump 161 and another tank, e.g., the tank Ta' as shown in FIG. 9 to the disposal tank 162.

According to this variation, the system can be used as a drainage system in case of emergencies such as floods and the like.

In the system as described above, although the jet pump 153 is used for pumping up the slurry to introduce it into the pressure tank, a pump, e.g., a slurry pump disposed in the slurry supplement pipe 125 may be used instead for pumping up it without using the jet pump 153. Further, although the the pumps 120 and 153 have many advantages such as almost no mechanical trouble, almost maintenance free and the like in comparison with the slurry pump, the slurry pump may be used instead.

What is claimed is:

1. A method for constructing a shaft, comprising the steps of:

(a) disposing an excavating machine at a working face of a shaft which is being excavated in a soft rock;

(b) pouring water into the shaft;

(c) excavating the soft rock by means of the excavating machine to deepen the shaft, thereafter spraying concrete onto a peripheral wall exposed above the surface of the water in the shaft to form a concrete layer on the peripheral wall;

(d) mixing the water and muck excavated from the working face of the shaft to form a slurry;

(e) conveying the slurry to outside of the shaft, said conveying being performed by a slurry-conveying apparatus comprising a pair of tanks and a main pump, said conveying step comprising: pumping said slurry from the working face alternately into the pair of tanks; filtrating the slurry introduced into one of the tanks and thereby separating water from the slurry; and supplying the separated water into the other tank through the main pump and thereby sending both the supplied water and the slurry in the other tank to the outside of the shaft;

(f) and controlling the amount of water poured into the shaft so as to adjust the water level in the shaft to a certain level and thereby allowing only a lower end of the excavating machine to be under the water, including measuring the water level in the shaft, and wherein the amount of water poured into the shaft is controlled on the basis of the measured water level.

2. A method for constructing a shaft, comprising the steps of:

(a) disposing an excavating machine at a working face of a shaft which is being excavated in a soft rock;

(b) pouring water into the shaft;

(c) excavating the soft rock by means of the excavating machine to deepen the shaft, thereafter spraying concrete onto a peripheral wall exposed above the surface of the water in the shaft to form a concrete layer on the peripheral wall;

(d) mixing the water and muck excavated from the working face of the shaft to form a slurry;

(e) conveying the slurry to outside of the shaft, said conveying step being performed by a slurry-conveying apparatus including three tanks; a first pump; and a second pump, said conveying step comprising: pumping said slurry from the working face into each of the tanks in turn by means of the first pump; filtrating the slurry introduced into one of the tanks and sending the filtrated slurry to the first pump; supplying water into one of the other two tanks by means of the second pump and thereby washing away slurry out of said one of the other two tanks so as to send them to the outside of the shaft; and converting the other tank from its pumping state into its washing-away state, whereby the pumping step, the washing-step, and the converting step are performed at the same time;

(f) and controlling the amount of water poured into the shaft so as to adjust the water level in the shaft to a certain level and thereby allowing only a lower end of the excavating machine to be under the water, including measuring the water level in the shaft, and wherein the amount of water poured into the shaft is controlled on the basis of the measured water level.

3. A machine for constructing a shaft comprising:

excavating means for excavating a shaft, the excavating means being adapted to be disposed at a working face of the shaft which is being excavated;

a water supplement means for pouring water into the shaft;

mucking means for mixing water in the shaft with muck excavated from the working face to form a slurry;

slurry-conveying means for conveying the slurry from the mucking means to the outside of the shaft, said slurry-conveying means including a pair of tanks for receiving the slurry from the mucking means; a main pump for pumping the slurry into and out of the tanks; a pair of filters for filtrating the slurry flowing from the tanks into the pump, each of the filters being interposed between the corresponding tank and the pump; and a plurality of second valves interposed between the main pump and the respective filters, for allowing the filtrated slurry to flow in a selected reversible direction from one tank to the other;

control means for controlling the amount of water poured into the shaft so that the water level in the shaft is adjusted to a certain level, said control means including measuring means for measuring the water level in the shaft; and a first first valve having a gate opening controlled on the basis of the water level measuring by the measuring means; and spraying means for spraying concrete onto a peripheral wall exposed above the surface of the water in the shaft.

4. A machine for constructing a shaft comprising:

excavating means for excavating a shaft, the excavating means being adapted to be disposed at a working face of the shaft which is being excavated;

a water supplement means for pouring water into the shaft;

mucking means for mixing water in the shaft with muck excavated from the working face to form a slurry;

said slurry-conveying means including three tanks for receiving the slurry from the mucking means; a first pump for pumping the slurry into the three tanks; a second pump for pumping water into the three tanks to wash away slurry from the tanks; three second valves, each including a main port, an inlet port, and an outlet port and having means for allowing the main port to be in communication selectively with the inlet port or the outlet port, the inlet port communicating with the second pump, the outlet port communicating with the first pump; and three filters for filtrating slurry flowing from the tanks into the first pumps, each of the filters being interposed between the corresponding tank and the main port of the corresponding second valve;

control means for controlling the amount of water poured into the shaft so that the water level in the shaft is adjusted to a certain level, said control means including measuring means for measuring the water level in the shaft; and a first first valve having a gate opening controlled on the basis of the water level measuring by the measuring means; and spraying means for spraying concrete onto a peripheral wall exposed above the surface of the water in the shaft.

5. A method according to claims 1 or 2, wherein said pouring step (b) is performed by a water supplement mean, said water supplement means comprising a pump for supplying water to said working face, a supplement pipe having opposite ends, one end being linked with said pump and the other end being extended to said working face, wherein the amount of water poured into the shaft is controlled by a first valve disposed on the way of said supplement pipe, and wherein the water level in the shaft is measured by a water gauge.

6. A method according to claims 1 or 2, wherein said spraying step is performed by a spray apparatus, said spray apparatus being rotatably disposed on said excavator for movement along said peripheral wall of said shaft.

7. A method according to claims 1 or 2, wherein said mixing step (d) is performed by a mucking apparatus, said mucking apparatus comprising a mucking pump for pumping up said muck and water of said working face, a crasher for crashing said muck pumped up by said mucking pump, and an agitating pump for agitating a mixture of said muck crashed and water to obtain a slurry.

8. A method according to claims 1 or 2, wherein said conveying step (e) includes a step of filtrating said slurry to separate muck from water of said slurry by means of a filter mounted in a tank and a step of conveying said muck separated from said slurry to outside of said shaft.

9. A method according to claims 3 or 4, wherein said water supplement means comprises a pump, a supplement pipe having opposite ends, one end being linked with said pump the other being extended to said working face, wherein the first valve is disposed in a midway of said supplement pipe, and and wherein the measuring means comprises a water gauge.

10. A machine according to claims 3 or 4, wherein said spraying means is rotatably mounted to said excavating means for movement along said peripheral wall of said shaft.

11. A machine according to claims 3 or 4, wherein said mucking apparatus comprises a mucking pump which sucks said muck and water in said working face, a crasher for crashing said muck from mucking pump, and an agitating pump for agitating a mixture of said crashed muck and water to obtain a slurry.

* * * * *